US008826470B2

(12) United States Patent
Helf et al.

(10) Patent No.: US 8,826,470 B2
(45) Date of Patent: Sep. 9, 2014

(54) AEROSOL DISPENSER CONTROL SYSTEM

(75) Inventors: Thomas A. Helf, New Berlin, WI (US); Jeffrey L. Crull, McFarland, WI (US); James R. Crapser, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 867 days.

(21) Appl. No.: 12/784,651

(22) Filed: May 21, 2010

(65) Prior Publication Data

US 2011/0283447 A1 Nov. 24, 2011

(51) Int. Cl.

| | |
|---|---|
| ***E03D 9/02*** | (2006.01) |
| ***B65D 83/26*** | (2006.01) |
| ***B65D 83/44*** | (2006.01) |
| *B05B 12/04* | (2006.01) |

(52) U.S. Cl.

CPC ..... *B65D 83/267* (2013.01); *B65D 83/44* (2013.01); *B05B 12/04* (2013.01)

USPC ..... 4/223; 222/649

(58) Field of Classification Search

USPC ..... 4/223; 222/649, 402.12, 402.13, 222/402.15, 402.1, 638

See application file for complete search history.

(56) References Cited

U.S. PATENT DOCUMENTS

| | | | | |
|---|---|---|---|---|
| 3,968,905 | A * | 7/1976 | Pelton | 222/649 |
| 5,239,491 | A * | 8/1993 | Mucciacciaro | 702/177 |
| 6,267,297 | B1 * | 7/2001 | Contadini et al. | 239/1 |
| 6,644,507 | B2 * | 11/2003 | Borut et al. | 222/37 |
| 6,820,821 | B2 | 11/2004 | Linstedt et al. | |
| 7,021,494 | B2 | 4/2006 | Mazooji et al. | |
| 7,603,726 | B2 | 10/2009 | Sawalski et al. | |
| 2003/0056587 | A1 | 3/2003 | Carpenter et al. | |
| 2007/0136937 | A1 * | 6/2007 | Sawalski et al. | 4/223 |
| 2008/0142555 | A1 | 6/2008 | Marin et al. | |
| 2009/0236362 | A1 | 9/2009 | Helf et al. | |
| 2010/0038379 | A1 | 2/2010 | Butler et al. | |

FOREIGN PATENT DOCUMENTS

| | | |
|---|---|---|
| CH | 645070 A5 | 9/1984 |

OTHER PUBLICATIONS

PCT/US2011/000895 International Search Report dated Aug. 5, 2011.

* cited by examiner

*Primary Examiner* — Huyen Le
*Assistant Examiner* — Lauren Heitzer

(57) ABSTRACT

Disclosed are automated aerosol dispensers for delivering chemicals (e.g. cleaners, fragrances, insect control agents) from the dispenser to selected locations (e.g. the air; a toilet bowl; a shower enclosure). There is an actuator (e.g. a push button or a foot pedal) for initiating dispensing, and a holder for an aerosol container. The aerosol container stores the chemical before use. There is a switch associated with the holder that recognizes when the aerosol container has been mounted to the holder, and when thereafter that aerosol container has been dismounted from the holder. A controller controls dispensing of the chemical from the aerosol container in response to actuation. The controller has a timer that determines the amount of time that chemical is to be delivered from the aerosol container upon the dispenser being actuated by the actuator. A database is provided for assisting the controller in varying the time that the timer permits dispensing in response to activation. The system thus can correct for pressure drop off in the can as the can nears empty.

9 Claims, 5 Drawing Sheets

AEROSOL DISPENSER CONTROL SYSTEM

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to devices for dispensing chemicals from an aerosol container in an automated manner. More particularly it provides dispensers which adjust the length of their automated dispensing cycles to correct for can pressure differentials resulting from the can being used in more and more emptied states.

Various devices have been developed where chemicals of interest (e.g. cleaning formulations; air treatment formulations) are dispensed from an aerosol container. For example, in U.S. Pat. No. 6,820,821 an automated shower enclosure cleaner dispenser was hung from a shower head. By pushing a button on the dispenser a controller caused shower cleaner to be automatically sprayed from the unit, for a set period. The cleaner could be stored in an aerosol container.

As another example, in U.S. patent application publication 2009/0236362 a dispenser was disclosed for dispensing air care product (e.g. insect repellent; fragrance) from an aerosol can, in an automated manner.

Note further that in U.S. Pat. No. 7,603,726 there was disclosed a toilet bowl cleaner dispenser. A spray nozzle was mounted over the rim of a toilet bowl, the nozzle being fed toilet bowl cleaner from an aerosol can whose spraying was triggered by a foot pedal.

A common feature of these and other analogous prior art systems is that they did not take into account pressure differences in the aerosol can that resulted as the chemical was being used. For instance, an automated ten second spray cycle when the aerosol can was completely filled could deliver more product than a ten second spray cycle when the can was three-quarters empty. This could result in too little product being delivered for some applications (when. the can was near empty) if the system was set based on expected delivery volume upon can initiation. Alternatively, if one set up the timing to insure adequate delivery when the can was near empty, chemical would be wasted when the can was newly installed.

In U.S. patent application publication 2003/0056587 a thermochromatic system was disclosed for indicating how much chemical was left in an aerosol can as it was being used. However, that information was not used to alter the length of the spray cycle as the can emptied.

Hence, a need still exists for improved automated aerosol dispensing systems.

BRIEF SUMMARY OF THE INVENTION

The invention provides an aerosol dispenser control system for delivering a chemical from an aerosol container that stores the chemical to a selected location. It has a holder for the aerosol container which "recognizes" if the aerosol container has been mounted to the holder and also "recognizes" if thereafter the aerosol container has been dismounted from the holder, and an actuator for initiating dispensing of the chemical from the aerosol container.

There is also a controller for controlling dispensing of the chemical from the aerosol container in response to initiation by the actuator. The controller has a timer that determines the amount of time that the chemical is to be delivered from the aerosol container in a spray cycle of the system upon the system being actuated by the actuator. The system also has means for varying the time that the timer specifies the chemical to be dispensed from the system in a spray cycle which reflects at least in part, directly or indirectly, the extent to which the aerosol container has previously dispensed chemical via the system (e.g. how many prior spray cycles; or actual remaining volume of chemical).

In one embodiment the means for varying the time establishes a shorter dispensing time for a newly installed aerosol container as compared to the time established by the means for varying time when the aerosol container has previously dispensed chemical multiple times via the system. The controller has a memory which stores a set of instructions that define varied dispensing times per spray cycle based upon the number of spray cycles that a newly installed aerosol container has been used for, and the controller can uses those instructions to set the timer accordingly.

The selected location can be selected from the group consisting of surrounding environmental air, surfaces of a plumbing fixture, room walls and room floors. For example, the chemical can be a toilet bowl cleaner and the selected location a toilet bowl. The term "chemical" or "chemistry" means one chemical or a mixture of chemical ingredients. In one embodiment, various cleaning and/or deodorizing chemicals are suitable for use in toilet bowl cleaning using a device according to the invention. As used herein, the term "cleaning" also includes sanitizing and/or disinfecting, and the term "deodorizing" also includes freshening.

In other preferred forms the actuator is a foot pedal or a push button, the holder includes a contact switch that can be depressed by insertion of the aerosol container in the holder, and the controller will cause the timer to set a spray cycle that is less than half as long when the aerosol container is first initiated after being newly installed than when the system is initiated after the aerosol container is at least three-quarters empty.

The controller most preferably has a memory which stores a set of instructions that define varied dispensing times for various stages after an aerosol container has been installed. The system could keep track of how many dispensing cycles have occurred since the original installation of a container, compare that number of cycles to the memory, and use the comparison to set the timer accordingly.

In another preferred form the holder is associated with a contact switch that is depressed by insertion of the aerosol container in the holder (and expanded by removal of the aerosol container from the holder). Depressing the switch sends a signal to the controller that a new can has been installed. Expanding the switch sends a signal to the controller that a used can has been removed. These are used to set and reset a counter in the controller. The counter is then compared to the memory table to obtain timing settings.

It should be appreciated that for many types of aerosol propellants, as the aerosol container begins to empty, the dispensing pressure of the propellant starts to drop. This presents a problem for automated systems where dispensing is based on a fixed dispensing time cycle. This effect is pronounced for some environmentally desirable propellant gases (e.g., compressed gases such as nitrogen and carbon dioxide), due to their tendency to separate in the can from the liquid being dispensed.

The present invention, in its most preferred forms, "keeps track" of when a can is newly installed, and thereafter how many dispensing cycles have occurred since that initial installation. That information is used by the controller to increase the length of the dispensing cycle as the can empties. With a predetermined protocol for varying the spray time one can achieve essentially constant volume delivery per initiation, throughout use of almost all of the can contents.

There can be other refinements as well. For example, the controller may be provided with an anti-vandalism feature which prevents dispensing more than twice per hour. Hence, any vandal seeking to prematurely use up the aerosol would be frustrated from trying repetitive spraying by such a feature.

Further, after a given number of dispensing cycles have occurred after the installation the device could be programmed to initiate a red indicator light (or provide another signal) to notify the consumer that the aerosol can will soon need to be changed.

Power can be supplied to the dispenser via a battery associated with the holder. Alternatively, the battery can be integrated with an aerosol can refill unit, or a power cord connectible to room power could be linked to the holder/controller.

It should be appreciated that the present invention helps avoid wasting active that is dispensed from an aerosol can. It also helps minimize the incidence of activation cycles where too little active is dispensed to be fully effective, and provides a way of advising the public when the aerosol can needs to be refilled.

The foregoing and other advantages of the present invention will be apparent from the following description. In that description reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

DETAILED DESCRIPTION OF THE PREFERRED EMBODIMENTS

Figure 1A:
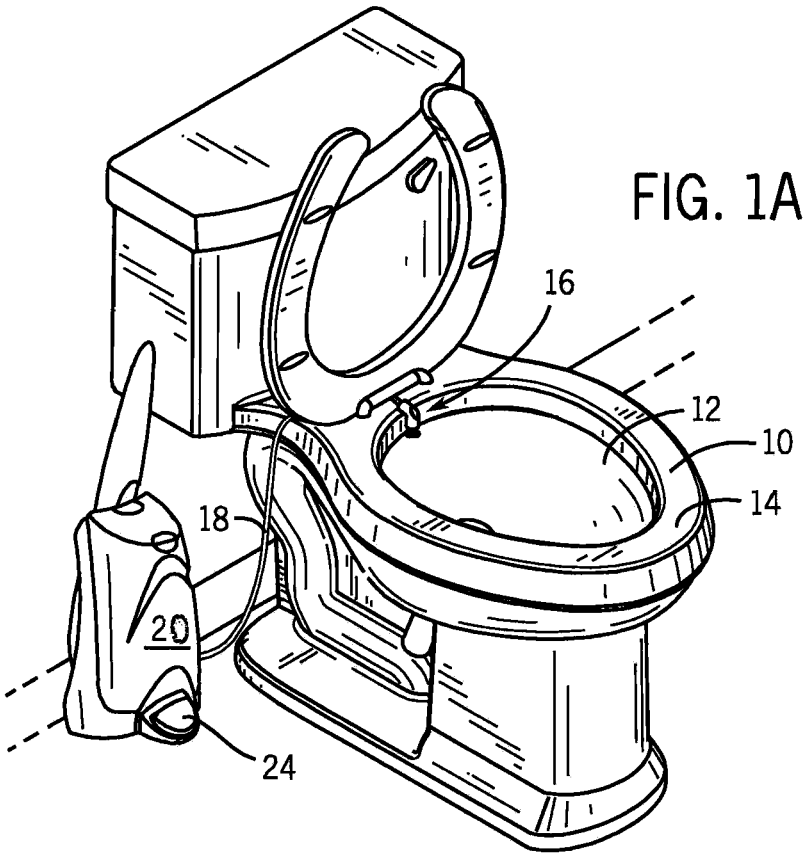
FIG. 1A is a perspective view of a prior art automated toilet bowl cleaning assembly.
Figure 1B:
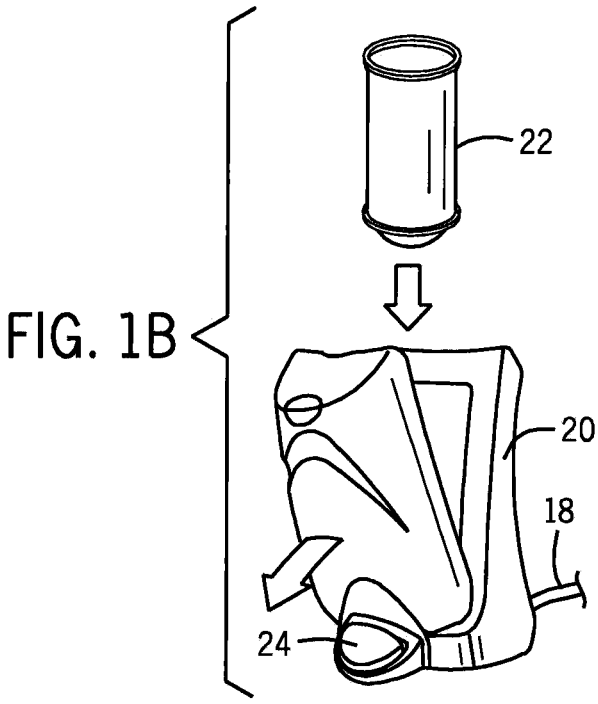
FIG. 1B is an enlarged, partially exploded view, of a prior art holder/activator used therewith.

FIGS. 1A and 1B show a prior art toilet 10, per FIGS. 11A-D of U.S. Pat. No. 7,603,726. Toilet 10 has a frontal basin 12 with a top rim 14. A spray nozzle 16 is hooked over the rim and fed by a line 18. The line 18 links to a holder 20 to which is mounted an aerosol container 22. Pressing down on a foot pedal 24 causes spraying of cleaner along the toilet bowl sides. This is a non-automated system that sprays for as long as the pedal is depressed.

Figure 2:
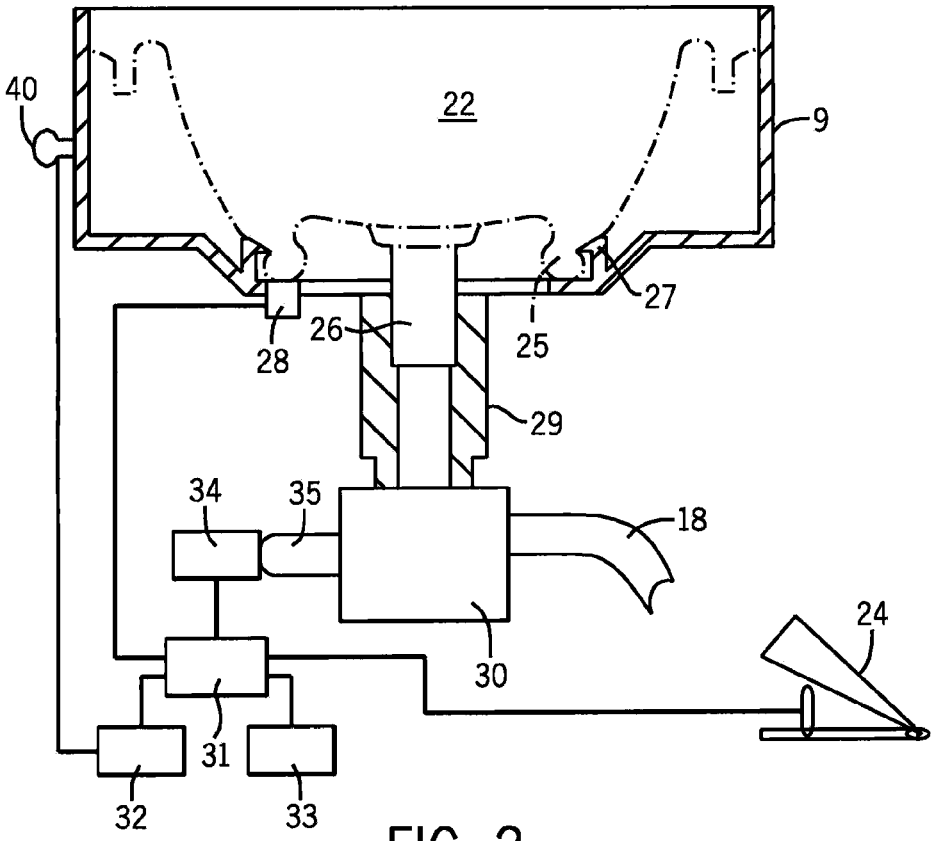
FIG. 2 is a partially cross sectional, partially schematic, view showing an aerosol can mounted in a holder of the present invention, with associated other parts of the dispenser control system of the present invention.

As shown in FIG. 2, such a system can have the linkage between the foot pedal 24 and can modified by instead using a control system of the present invention. The can may have an upper rim 25 and the usual valve stem 26. The rim 25 is caught by snap retainers 27 such that the rim is held down on switch 28 and the valve stem 26 carries continuous pressure through conduit 29 to valve 30. Insertion of a can 22 sends a signal to controller 31 to reset counter 32. When someone then steps on pedal 24 this sends an electrical signal to the controller 31. The controller 31 checks the counter 32, and then compares the counter value in a table memory 33 to determine the required spray time for that cycle. Then, the controller 31 energizes a solenoid 34 which presses an actuator 35 for the specified time, and then releases the actuator. This releases the cleaner through conduit 18 for the specified time.

Contact of the rim 25 informs the switch 28, and thus the controller 31, of when a new can is installed. Removal of the can 22 causes the switch 28 to signal the controller that no can is present, and that a new can may soon be installed. After each spray cycle the controller increments the counter 32 by one.

When the counter 32 exceeds a preset value (e.g. 40 cycles), an indicator light 40 will be lit until the can 22 is removed from the holder 9. This advises the public that the can should be replaced.

The controller 31 may also be programmed override actuation if more than one cycle has been initiated within too short a time.

Figure 3:
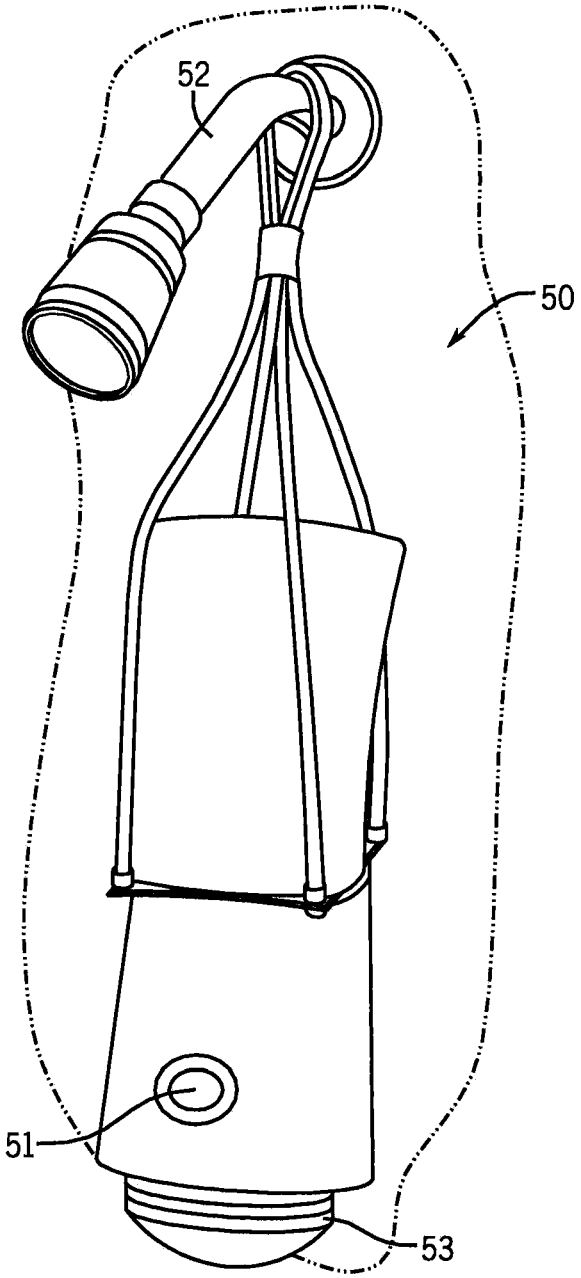
FIG. 3 is a right frontal perspective view of a prior art automated shower enclosure wall cleaner assembly.

FIG. 3 depicts the prior art automated shower cleaner unit 50 of U.S. Pat. No. 6,820,821. There is a push button 51 that activates a spray cycle from an aerosol canister (not shown). The unit 50 is hung from a shower head 52 and delivers cleaner spray out a lower nozzle.

The principles of the present invention could also be applied to a device like this. In this regard, the push button 51 could replace the actuator 24 and be linked to a controller system like that of FIG. 2, which provides for cycle time modification based on can usage.

Figure 4:
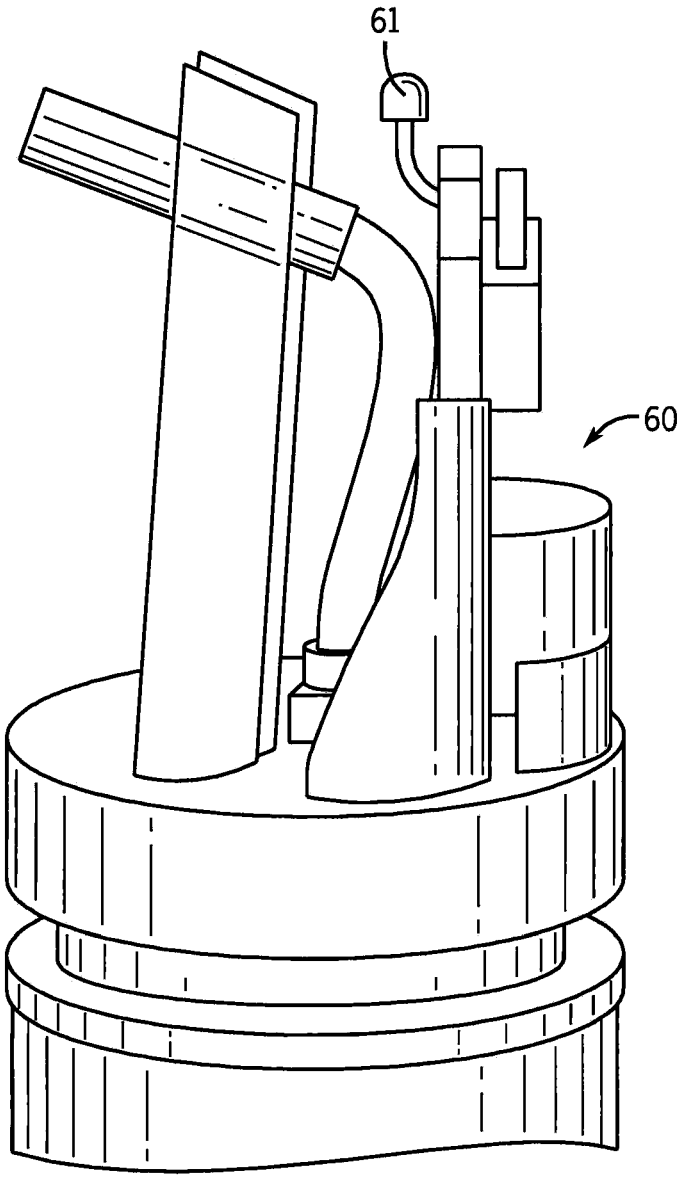
FIG. 4 is a frontal view of a prior art automated air care dispenser.

FIG. 4 shows an automated air care sprayer 60 as taught in U.S. patent application publication 2009/0236362. The principles of the present invention could also be applied to this type of product as well. In this regard, their actuator 61 could replace actuator 24 of FIG. 2.

Figure 5:
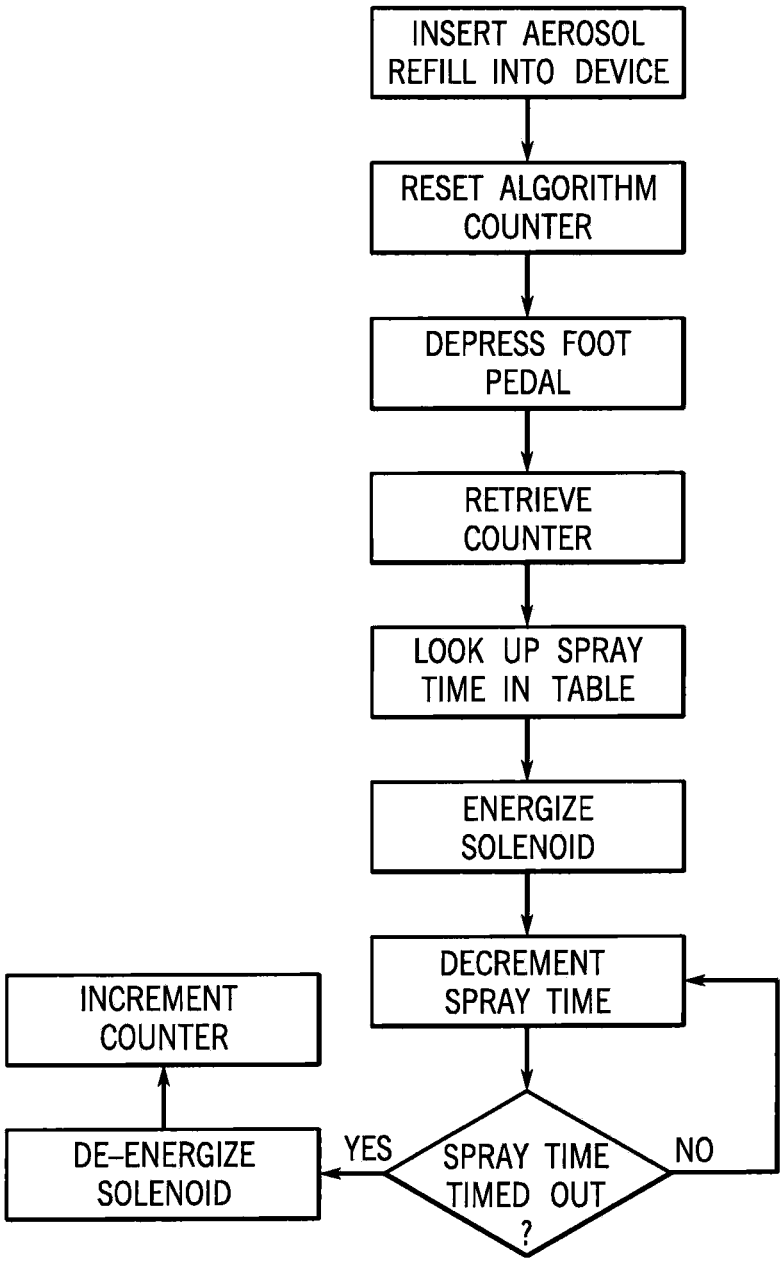
FIG. 5 depicts a flow chart of a preferred control algorithm of the present invention.

FIG. 5 depicts in flow chart form a control algorithm for a preferred holder of the present invention.

While preferred embodiments of the present invention have been described above, it should be appreciated that the invention could be applied in a variety of other embodiments. For example, a system could be constructed to read actual pressures or liquid levels within the can, and use that information to adjust spray time. Alternatively a system could measure volume leaving the can during each spray cycle, and use that information to adjust the length of future cycles. These and other modifications may be made without departing from the spirit and scope of the invention. Thus, the claims (rather than just the preferred embodiments) should be reviewed in order to understand the full scope of the invention.

INDUSTRIAL APPLICABILITY

Disclosed are improved automated dispensers for dispensing aerosol can contents in a more consistent fashion.

What is claimed is:

1. An aerosol dispenser control system for delivering a chemical from an aerosol container that stores the chemical to a selected location, the system comprising:

a holder for the aerosol container, wherein the holder has a switch that recognizes if the aerosol container has been mounted to the holder and also recognizes if thereafter the aerosol container has been dismounted from the holder;

an actuator for initiating dispensing of the chemical from the aerosol container;

a controller for controlling dispensing of the chemical from the aerosol container in response to initiation by the actuator, wherein the controller has a timer that determines the amount of time that the chemical is to be delivered from the aerosol container in a spray cycle of the system upon the system being actuated by the actuator; and wherein the controller further comprises means for automatically increasing the time that the timer specifies the chemical to be dispensed from the system in a spray cycle which reflects at least in part the extent to which the aerosol container has previously dispensed chemical via the system;

wherein said means for automatically increasing the time comprises a counter to track how many times the aerosol container has already experienced a spray cycle, and a memory that stores a set of instructions that define varied dispensing times based upon the number of spray cycles that a newly installed aerosol container has been used for;

whereby said means for automatically increasing the time establishes an increased dispensing time per spray event when the aerosol container has previously dispensed chemical multiple times via the system, as compared to a dispensing time for a newly installed aerosol container;

whereby the system is configured to help correct for pressure drop off in the container as the container approaches empty, and thereby help achieve more constant volume of dispensing per spray event as the can approaches empty.

2. The aerosol dispenser control system of claim 1, wherein the controller can use the instructions to set the timer accordingly.

3. The aerosol dispenser control system of claim 1, wherein the selected location is selected from the group consisting of surrounding environmental air, surfaces of a plumbing fixture, room walls and room floors.

4. The aerosol dispenser control system of claim 1, wherein the chemical is a toilet bowl cleaning chemical and the selected location is a toilet bowl.

5. The aerosol dispenser control system of claim 1, wherein the chemical is a toilet bowl deodorizing chemical and the selected location is a toilet bowl.

6. The aerosol dispenser control system of claim 1, wherein the actuator is a foot pedal.

7. The aerosol dispenser control system of claim 1, wherein the actuator is a pushbutton.

8. The aerosol dispenser control system of claim 1, wherein the switch is in a form of a contact switch that can be depressed by insertion of the aerosol container in the holder.

9. The aerosol dispenser control system of claim 1, wherein the controller will cause the timer to set a spray cycle that is less than half as long when the aerosol container is first initiated after being newly installed than when the system is initiated after the aerosol container is at least three-quarters empty.

* * * * *